US005416935A

United States Patent [19]

Nieh

[11] Patent Number: 5,416,935

[45] Date of Patent: May 23, 1995

[54] CUSHION SURFACE AIR CONDITIONING APPARATUS

[76] Inventor: Rosa L. Nieh, 14345 Hollyhock Way, Burtonsville, Md. 20866

[21] Appl. No.: 158,846

[22] Filed: Nov. 29, 1993

[51] Int. Cl.[6] ..... A47C 21/04

[52] U.S. Cl. ..... 5/423; 5/469; 5/284; 297/180.13

[58] Field of Search ..... 297/180.1, 180.13, 180.14, 297/180.16; 5/284, 421, 423, 453, 468, 469; 2/261

[56] References Cited

U.S. PATENT DOCUMENTS

| | | | |
|---|---|---|---|
| 1,664,636 | 4/1928 | Mayer | 297/180.1 X |
| 2,493,067 | 1/1950 | Goldsmith | 5/469 X |
| 2,782,834 | 2/1957 | Vigo | 62/261 X |
| 3,230,556 | 1/1966 | Shippee . | |
| 3,266,064 | 8/1966 | Figman | 5/423 X |
| 3,486,177 | 12/1969 | Marshack . | |
| 3,529,310 | 9/1970 | Olmo . | |
| 3,648,469 | 3/1972 | Chapman | 5/423 X |
| 3,928,876 | 12/1975 | Starr . | |
| 3,942,202 | 3/1976 | Chevrolet . | |
| 4,008,498 | 2/1977 | Thomas . | |
| 4,141,585 | 2/1979 | Blackman . | |
| 4,149,285 | 4/1979 | Stanton | 5/453 |
| 4,218,791 | 11/1980 | Itoku . | |
| 4,391,009 | 7/1983 | Schild et al. . | |
| 4,673,605 | 6/1987 | Sias et al. . | |
| 4,712,832 | 12/1987 | Antolini et al. . | |
| 4,867,230 | 9/1989 | Voss . | |
| 4,946,220 | 8/1990 | Wyon et al. . | |
| 4,981,324 | 1/1991 | Law . | |
| 4,997,230 | 3/1991 | Spitalnick . | |
| 5,001,793 | 3/1991 | Liu | 5/468 X |
| 5,002,336 | 3/1991 | Feher . | |
| 5,004,294 | 4/1991 | Lin | 297/180.13 X |
| 5,016,302 | 5/1991 | Yu . | |
| 5,030,495 | 7/1991 | Neu . | |
| 5,125,238 | 6/1992 | Ragan et al. . | |
| 5,160,517 | 11/1992 | Hicks et al. . | |
| 5,181,287 | 1/1993 | Yang . | |

*Primary Examiner*—Michael F. Trettel
*Attorney, Agent, or Firm*—Cushman, Darby & Cushman

[57] ABSTRACT

A surface air conditioning device includes a plurality of passages through a support surface which overlies a closed volume in which temperature conditioned air is supplied; each passage is provided with a pressure actuated flow control valve which is normally closed to prevent loss of conditioned air through the associated passage; pressure contact with the valve effects opening thereof to allow conditioned air to flow through the passage.

24 Claims, 3 Drawing Sheets

CUSHION SURFACE AIR CONDITIONING APPARATUS

FIELD OF THE INVENTION

The present invention relates to compact, portable air conditioning systems for localized cooling of a surface such as a cushion or bed and, more particularly, to an apparatus that will diminish energy consumption while providing a more comfortable environment for the user of such a cushion.

BACKGROUND OF THE INVENTION

In a large number of localities, the temperature conditions are such that for a large portion of the year sleeping is difficult or impossible due to the extremes of heat, humidity and/or freezing or below freezing temperatures. Typically, in many of such regions, economic development as well as the presence of sufficient electrical power are both insufficient to enable the inhabitants to afford the substantially more expensive and more energy consumming space air conditioners that have enjoyed widespread use in the developed countries of the world where manufacturing expertise is widely available and electrical power is plentiful. There has been, accordingly, a critical need in developing and underdeveloped countries to provide an alternative to space or room air conditioners both in the extreme cold as well as the very hot climates particularly where evening temperatures drop well below freezing in the northern latitudes while the nighttime temperatures in the tropical climates often do not drop below 80° F. with commensurately high humidity. Among these alternatives, the prior art has proposed cushion or bed mattress structures where air is pumped through apertures in the mattress or surface layer on which the user will position his body for rest. An air conditioning compressor and/or heater will be provided adjacent the mattress to conduct conditioned air into a compartment usually subjacent the user's body where a fan or similar fluid pump will force the conditioned air up through the apertures provided in the mattress. See, in this regard, U.S. Pat. No. 3,266,064 of Aug. 16, 1966.

While this and similar type structures provide some degree of relief from the temperature extremes such as by forcing cooling or heated air to the surface of the mattress, it is not likely that such structures would enjoy widespread acceptance since there has been no control over the release of the conditioned air so that a large portion of the power consumed in conditioning the air would be wasted as a result of free flow of the conditioned air through the open apertures.

SUMMARY OF THE INVENTION

The present invention overcomes the foregoing disadvantage and provides a relatively inexpensive and reliable control for the release of conditioned air provided by a compact power source such as a compressor and/or heater or a combination of such devices and involves the positioning of a plurality of valves in passages provided in the support layer of the cushion or mattress. The valves are pressure actuated so that it is only where a user actually positions a portion of his body on or adjacent to a passage that the associated valve will be actuated to move from a normally closed to an open position to release conditioned air to the surface of the mattress or cushion. In this manner, uncontrolled loss of conditioned air while the cushion is not in use will be substantially, if not entirely, prevented. This is particularly significant in hot climates where operation of the compact air conditioners that can be used with such a structure can be more efficiently carried out to provide cooling or warming air to a user while operating with a consumption of electric power or fuel that will be substantially lower than that of the prior art devices which endeavor to provide similar comfort to a user.

In a preferred embodiment, the present invention provides a valve member for insertion in passages provided in the support layer of a mattress or cushion or the like with the valve member normally preventing flow through the associated passage to the support surface of the mattress or cushion. The valve member includes a spring biased valve stem, the upper end of which projects a small distance above the surface of the valve body so that when a user rests a portion of his body on the individual valve, the valve stem will be depressed to open a through passage so that the conditioned air contained within the interior of the mattress will be released to flow either under pressure of a pump or as a result of compression of the interior chamber by the weight of the user on the upper supporting layer through the valve to be expelled over the surface and adjacent to the surface of the support layer. Additionally, the present invention provides the unique control of the dispensing of the conditioned air in conjunction with a small portable air conditioner which can either be located in the interior of the cushion or mattress, beneath the supporting layer to provide the air conditioning, either cooling or warming, as required, or the air conditioning unit may be located externally of the mattress or cushion and connected to the interior volume located below the support surface by a suitable conduit. The pressure delivered from the external air conditioner may be sufficient to provide an inflation to the interior chamber of the mattress or cushion or, alternately, and more conventionally, coil springs may be located in the interior volume according to conventional practice.

With the arrangement of the present invention, the user may readily adjust the temperature of the air delivered through the flow control valves distributed over the support surface layer and by suitable adjustment of a fan that may be provided, the local temperature immediately above and within the range of the user's body may be suitably modified.

The foregoing and other objects of the present invention will become apparent as consideration is given to the following specification taken in conjunction with the accompanying drawings.

DETAILED DESCRIPTION OF THE INVENTION

Figure 1:
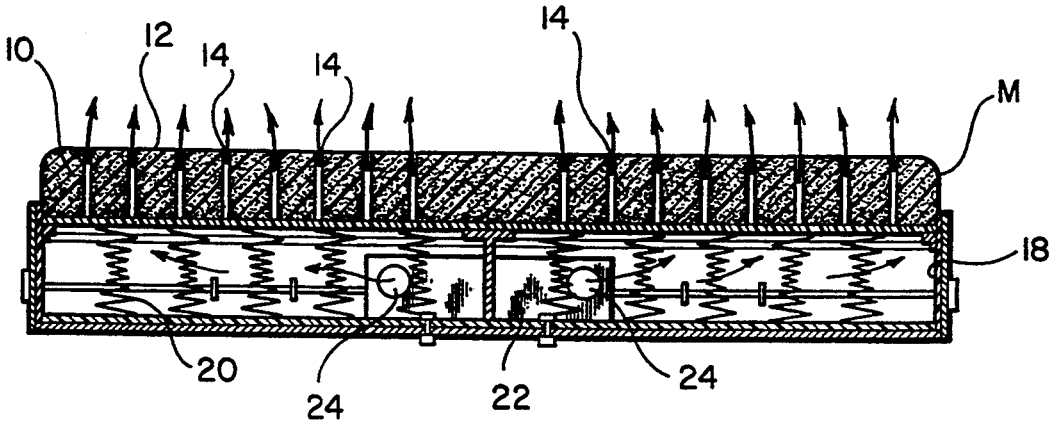
FIG. 1 PRIOR ART
FIG. 1 is a side view in section of a conventional mattress providing air conditioning apertures through the support layer from an internal source.

Referring out of the drawings wherein like numerals designate corresponding parts throughout the several views there is shown in FIG. 1 a sectional view of a mattress of the prior art. The mattress M includes a cushioned layer 10 through which a plurality of passages 14 are provided and which are distributed substantially evenly over the surface 12 of the cushion layer. Each of the passages 14 extends completely through the cushion layer 10 to open on an interior volume of the mattress which, in the illustrated embodiment, is supported on coil springs 20. The interior volume 18 substantially underlies the cushion layer 10 and provides a reservoir for conditioned air which may be provided from an external source or from an internal air conditioner 22. Depending on the local climate, the air conditioner 22 may be of the type that only provides cooling air from its vents 24 or may be of the type that provides, upon selection, cooling or warmed air. For colder climates, of course, an air conditioner that only provides warmed air would be required. In the illustrated structure, when the air conditioner 22 is actuated, the conditioned air will pass upwardly through the passages 14 when a user positions his body on the upper layer 12 which results in a compression of the interior volume 18 causing the air flow. In other structures, of course, the air conditioner 22 may be of the type that provides an elevated gas pressure in the interior volume causing flow as a result of a pressure difference in addition to or as an alternative to compression of the volume 18. With the arrangement of FIG. 1, it is clear that the power utilized to actuate the air conditioner 22 would be continuously lost through the passages 14 in the form of heat or cooled air once the device was set in operation in view of the absence of any control of flow through the passages 14 such as when the mattress is not being occupied by a user.

Figure 2:
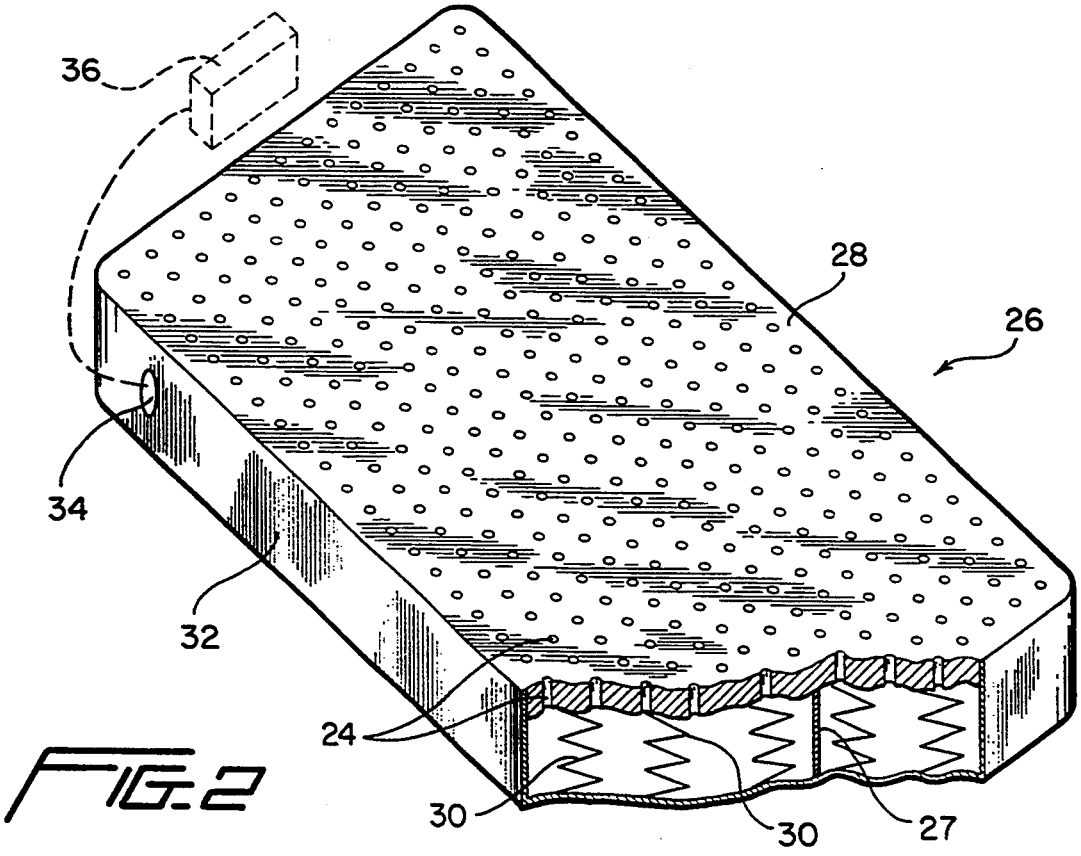
FIG. 2 is a prospective view with parts broken away showing a mattress or cushion utilizing the present invention where an external source would be utilized to provide conditioned air to the interior volume of the mattress.

With reference to FIG. 2, there is shown a preferred embodiment of a body support in the form of a mattress 26 having an upper support surface 28 in which there are provided, in a substantially uniform distribution, a plurality of passages 24 which, in the sectional view, are shown as extending completely through the support layer 28 of the mattress 26. An interior volume 27 is provided which is generally closed and is preferably air tight for efficiency purposes. Coil springs 30 may be distributed over the interior volume 27 as is conventional. In one embodiment, the side wall 32 of the mattress 26 is provided with a normally closed connecting aperture 34 for receiving a conduit from an external air conditioner as schematically shown at 36. With such an arrangement, an air conditioner can be employed to supply several different mattresses which would be useful in dormitories, hospitals, and the like. Each passage 24 is provided with a normally closed valve 40 as described below.

Figure 4:
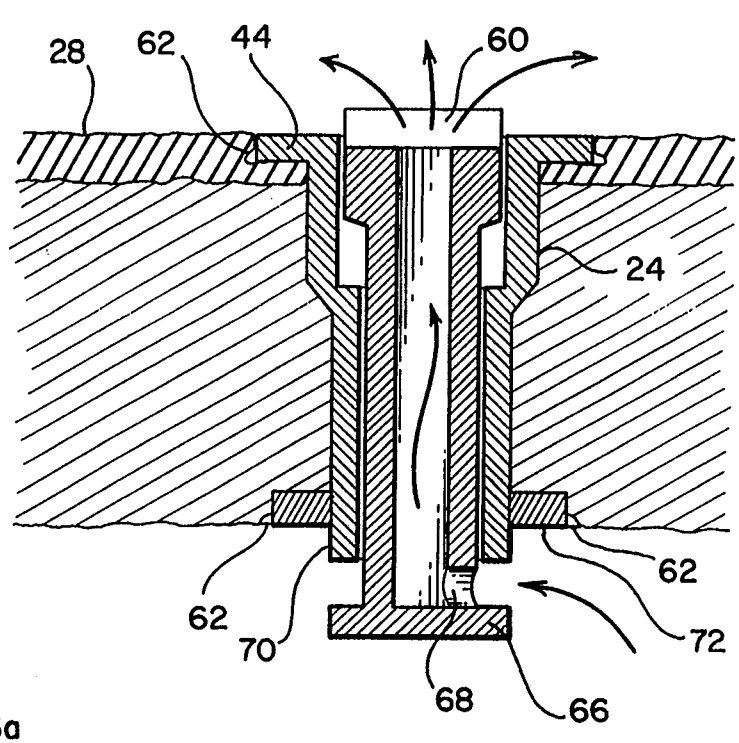
FIG. 4 is an illustration,similar to FIG. 3, of the use of the flow control valve of the present invention in a mattress or cushion structure with the valve in an open position.
Figure 3:
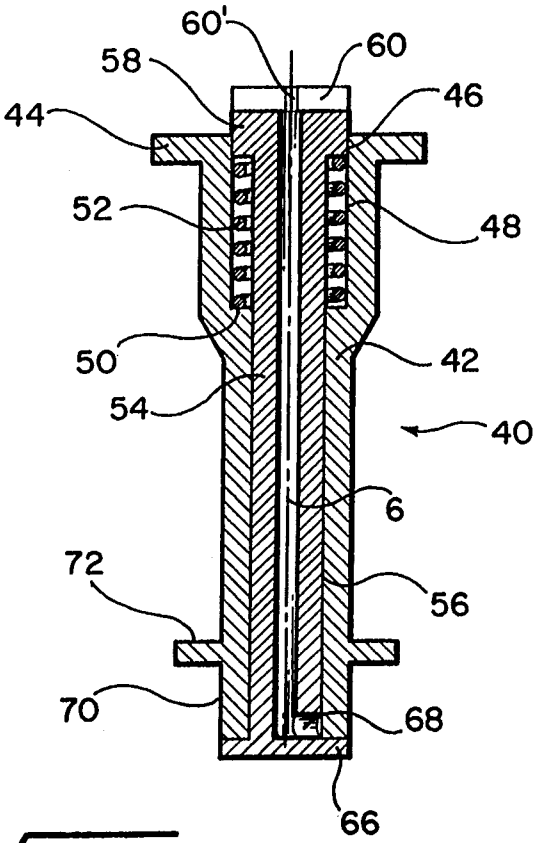
FIG. 3 is an elevational view in section along the longitudinal axis of one flow control valve of the present invention.

With reference now to FIG. 3, there is shown an elevational view in section, along the longitudinal axis, a flow control valve 40 of the present invention. The flow control valve 40 includes a tubular body 42 having an upper end provided with an annular radially extending flange 44 surrounding an opening 46 of a counterbore 48. The counterbore has at its inner end a radial shoulder 50 supporting one end of a coil spring 52. A valve member 54 is slidably disposed in the bore 56 of the tubular body 42. At its upper end, the sleeve valve 54 has an enlarged head 58 which includes a transverse radial extending slot 60 and a longitudinal axial bore 62 extending to a transverse plate 66 located at the opposite end of the sleeve valve 54. A transverse aperture 68 is provided adjacent the flange 66 for reasons that will be described below. Adjacent the lower end 70 of the body 42 is another annular flange 72. The flanges 44 and 72 are provided to facilitate attachment of the valve 40 in a passage 14 formed in the support layer 28 of the mattress or cushion with which it is to be used as shown in FIG. 4. In FIG. 3, the valve sleeve 54 is in its closed position. Thus, with the flanges 44 and 72 attached to the upper and interior surfaces, respectively of the support layer 28 in a sealed fashion such as by an epoxy adhesive, and with no pressure exerted on the head 58 by a portion of a user's body or other object, the coil spring 52 will urge the head 58 upwardly to maintain the lower end 70 of the body 42 closed about the opening 68. However, when pressure is applied to the head 58, the valve stem 54 will be moved toward the position shown in FIG. 4 with the head 58 becoming substantially flush with the surface 28 of the mattress 26. Other means of attaching the valve 40 in the respective passages 24 will be readily apparent to those skilled in this art.

It will be apparent that except when a body is resting on at least a portion of the surface 28 of the mattress 26, no conditioned air will be able to escape through the passages 24 where a flow control valve 40 has been installed. It is clearly desirable that the force or spring constant of the coil spring 52 be extremely light so that depression of the valve sleeve 54 can be readily effected even by a light touch of a person's body such as the hand or elbow. Further, the slot 60 may be supplemented by one or more intesecting slots to improve circulation.

Figure 5B:
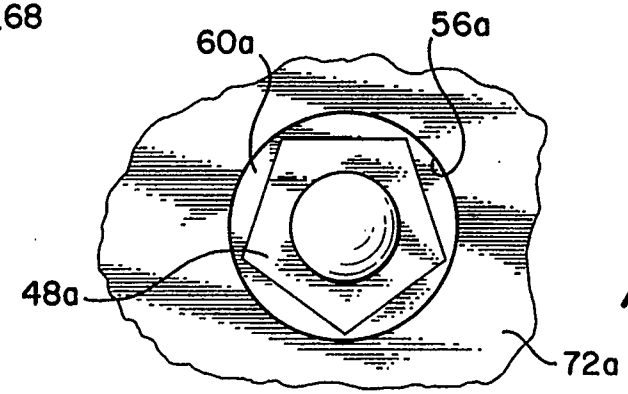
FIG. 5*a* is an elevational view in section along the longitudinal axis of another flow control valve of the present invention and FIG. 5*b* is top view of the valve with the pin removed.
Figure 5A:
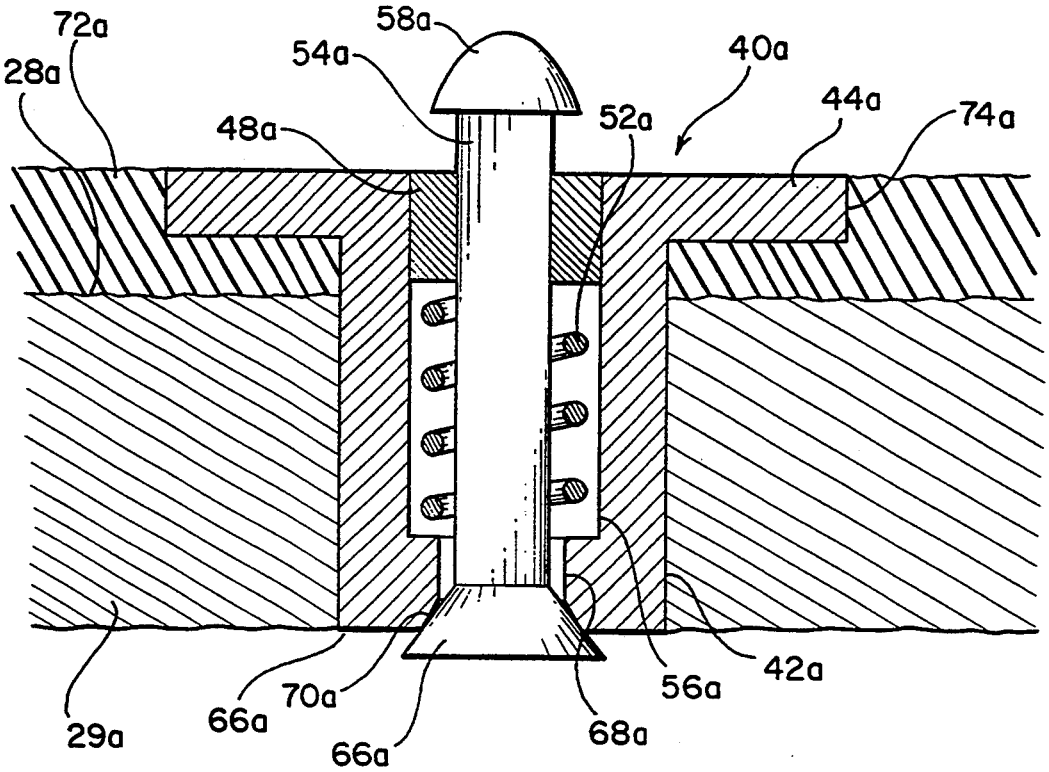

In FIG. 5*a*, there is shown an alternate embodiment of a flow control valve **40*a* which has a cylindrical body 42*a* and an enlarged flange 44*a* extending radially about the upper end of the body 42*a*. The base 66*a* is provided with a cylindrical opening 68*a*, the lower end of which is frustoconically relieved at 70*a*. A pin 54*a* is movably disposed in the cylindrical bore 56*a* of the body 42*a* and is provided with an integral conical base 66*a*, the side of which sealingly engages the lower end 70*a* of the opening 68*a* when in its rest or first position. The head 58*a* of the pin 54*a* is rounded to eliminate any discomfort during use. Intermediate the ends of the pin 54*a*, a hexagonal nut 48*a* is adjustably positioned as by threading on the pin 54*a* which may be threaded to cooperate with the nut 48*a*. The nut may be fixedly positioned on the pin 54*a* by an adhesive, if desired. A coil spring 52*a* is located about the pin 54*a* and has one end resting against the inner side of the nut 48*a* and its opposite end engaging the inner surface of the base 66*a* of the body 44*a*. When a user engages the head 58*a* of the pin 54*a*, the pin will move longitudinally of the body 44*a* to move the base 66*a* away from the lower end 70*a* of the opening 68***a* to allow air to pass through the bore 56*a* and through the spaces 60*a* (shown in FIG. 5*b*) past the nut 48*a*.

In this embodiment, the valves 40*a* may be embedded in strips of plastic material 72*a* which are fastened by sewing or by an adhesive to the upper surface 28*a* of the support layer 29*a*. Preferably, the strips 72*a* are positioned in evenly spaced relation over the surface 28*a* in rows extending parallel to one another with each row including a plurality of spaced valves 40*a*. The flange 44*a* of each valve 40*a* may be adhesively held in a complementary shaped recess 74*a* of each strip 72*a*.

The body and pin of each valve 40 and 40*a* may made from a durable plastic material such as polyethylene or may be made of an inexpensive metal.

With the passages 24 distributed substantially as shown in FIG. 2, it is estimated that an air conditioner having an output of 340 btu/hr will be sufficient to provide a comfortable surface atmosphere for a user so that the user will be able to sleep comfortably while consuming a fraction of the power that would be required to air condition to a comfortable level such as 75° F. an entire bedroom located in a tropical climate. Conversely, in a harsh northern climate, during the winter months, a householder will be able to reduce fuel consumption, either gas, oil or electrical power, during the nighttime hours since the bed will provide a warm and safe environment in a relatively confined space with no significant loss of thermal energy other than that released by the flow of air through open valves 40. Even where such flow occurs, heat retention will be enhanced by the presence of a surface covering such as a blanket or quilt.

Figure 6:
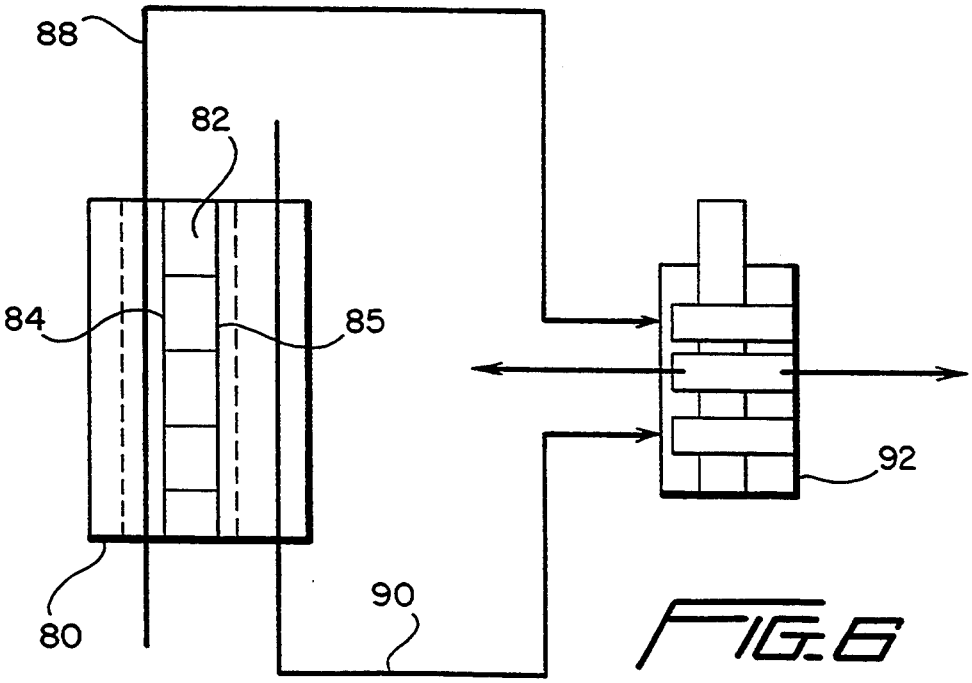
FIG. 6 is an illustration of a temperature controlling circuit for use with the arrangement of the present invention.

FIG. 6 illustrates a flow circuit provided where the air conditioner is in the form of a heat exchanger 80. In one form, the exchanger 80 may use a Peltier junction 82 which on side 84 provides a cooling surface and on the opposite side 85 provides a surface at a higher temperature. Ducts 88 and 90 will carry the conditioned air to a distribution valve 92, which may be manually operated to control which flow stream is delivered to the mattress.

It will be apparent to those skilled in this art that the principles of the present invention may equally be applied to a cushioned chair, bench or other furniture article where a support surface is employed and where users tend to remain still for appreciable periods of time.

Various modifications may be made to the present invention without departing from the spirit and scope of this invention as defined in the appended claims.

What is claimed is:

1. A flow control device for a flexible support of the type having an interior volume bounded in part by a surface on which a user positions at least a portion of the user's body, the interior being supplied with air at a selected temperature and the surface having a plurality of passages therethrough in communication with the interior volume, said device comprising a member positionable in a passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, said device comprising a tubular member having opposite open ends and having a longitudinal bore and a counter bore adjacent one end of said tubular member, said valve element comprising a sleeve and said flow path comprises a bore in said sleeve extending from one end of said sleeve to adjacent the opposite end, said opposite end of said sleeve having a flange plate having a portion thereof movable into engagement with said other end of said tubular member when said valve element is in said first position, said sleeve having a transverse aperture communicating said bore in said sleeve with the exterior of said sleeve.

2. The invention as claimed in claim 1 wherein said device includes a resilient member urging said valve member to said first position.

3. The invention as claimed in claim 1 wherein valve element has a first end adjacent said one end of said member and a shoulder adjacent said first end, said shoulder extending radially from said valve element to slidably engage said counter bore of said member, said counterbore extending along said member from a base to the said one open end of said member, a coil spring disposed in said counterbore and having one end engaging said shoulder and an opposite end engaging said base of said counterbore.

4. The invention as claimed in claim 3 wherein said member has a selected length and said first end of said valve element, when in said first, closed position, projects beyond said one end of said member.

5. The invention as claimed in claim 4 wherein said first end of said valve member includes a slot extending transverse to and intersecting said longitudinal bore to provide a transverse flow path.

6. The invention as claimed in claim 1 wherein said member includes external, radially extending attachment flanges adjacent each end.

7. A support having an interior volume and a support layer extending over at a portion of said interior volume and having an upper surface for supporting at least a portion of a body, said support layer having a selected thickness and a plurality of spaced apart passages therethrough communicating with said interior volume, at least some of said passages having a flow control device comprising a member positioned in a passage and closing flow through said respective passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, said device comprising a tubular member having opposite open ends and having a longitudinal bore and a counter bore adjacent one end of said tubular member, said valve element comprising a sleeve and said flow path comprises a bore in said sleeve extending from one end of said sleeve to adjacent the opposite end, said opposite end of said sleeve having a flange plate having a portion thereof movable into engagement with said other end of said tubular member when said valve element is in said first position, said sleeve having a transverse aperture communicating said bore in said sleeve with the exterior of said sleeve.

8. The invention as claimed in claim 7 wherein said interior volume of said support includes air conditioning means for controlling the temperature of the air in said interior volume.

9. The invention as claimed in claim 8 wherein said device includes a resilient member urging said valve member to said first position.

10. The invention as claimed in claim 7 wherein said valve element has a first end adjacent said one end of said member and a shoulder adjacent said first end, said shoulder extending radially from said valve element to slidably engage said counter bore of said member, said counterbore extending along said member from a base to the said one open end of said member, a coil spring disposed in said counterbore and having one end engaging said shoulder and an opposite end engaging said base of said counterbore.

11. The invention as claimed in claim 7 wherein an air conditioner is connected to said interior volume for conditioning the temperature of the air in said interior volume.

12. A support having an interior volume and a support layer extending over at a portion of said interior volume and having an upper surface for supporting at least a portion of a body, said support layer having a selected thickness and a plurality of spaced apart passages therethrough communicating with said interior volume, at least some of said passages having a flow control device comprising a member positioned in a passage and closing flow through said respective passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, an air conditioner being connected to said interior volume for conditioning the temperature of the air in said interior volume, said air conditioner including an electrical circuit including a Peltier junction for cooling a surface, said air conditioner including a flow path for moving air over said surface and to said interior volume.

13. The invention as claimed in claim 12 wherein said flow path includes a flow control device.

14. A flow control device for a flexible support of the type having an interior volume bounded in Dart by a surface on which a user positions at least a portion of the user's body, the interior being supplied with air at a selected temperature and the surface having a plurality of passages therethrough in communication with the interior volume, said device comprising a member positionable in a passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, said member comprising a body having a first end and a second end opposite said first end, said first and second ends each having an opening, said body having a through passage extending between said first and second ends, said valve element comprising a pin movably carried in said through passage, said pin having a first end adjacent said first end of said body and a second end adjacent said second end of said body, said second end including a portion closing said opening of said second end of said body when said pin is in a first position, said first end of said pin extending through said opening at said first end of said body whereby when a load is imposed on said first end of said pin, said pin will move to a second position where said portion will be moved away from said opening at said second end of said body to allow air to pass through said through passage.

15. The invention as claimed in claim 14 wherein said body includes resilient means urging said pin toward said first position.

16. The invention as claimed in claim 15 wherein said second end of said body includes a base and said resilient means comprises a spring.

17. The invention as claimed in claim 16 wherein said through passage is a cylindrical bore, said pin includes a nut mounted thereon adjacent said first end thereof, said pin having a diameter less than the diameter of said through passage, said nut having an annular width sufficient to engage a portion of said bore, said nut having an external peripheral shape to allow air flow past said nut.

18. The invention as claimed in claim 14 wherein said body has adjacent said first end thereof a peripheral flange for insertion into a recess in a strip attachable to a flexible support.

19. A flow control device for a flexible support of the type having an interior volume bounded in part by a surface on which a user positions at least a portion of the user's body, the interior being supplied with air at a selected temperature and the surface having a plurality of passages therethrough in communication with the interior volume, said device comprising a member positionable in a passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, said member including external, radially extending attachment flanges adjacent each end.

20. The invention as claimed in claim 19 wherein said member has a selected length and said first end of said valve element, when in said first, closed position, projects beyond said one end of said member.

21. The invention as claimed in claim 20 wherein said first end of said valve member includes a slot extending transverse to and intersecting said longitudinal bore to provide a transverse flow path.

22. A support having an interior volume and a support layer extending over at a portion of said interior volume and having an upper surface for supporting at least a portion of a body, said support layer having a selected thickness and a plurality of spaced apart passages therethrough communicating with said interior volume, at least some of said passages having a flow control device comprising a member positioned in a passage and closing flow through said respective passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, said member includes external, radially extending attachment flanges adjacent each end.

23. The invention as claimed in claim 22 wherein said support layer has an interior surface, said attachment flanges being adhesively secured respectively to said upper and said interior surfaces.

24. A support having an interior volume and a support layer extending over at a portion of said interior volume and having an upper surface for supporting at least a portion of a body, said support layer having a selected thickness and a plurality of spaced apart passages therethrough communicating with said interior volume, at least some of said passages having a flow control device comprising a member positioned in a passage and closing flow through said respective passage, said member including a valve element carried by said member, said valve element including a flow path, said valve element being movable relative to said member between a first position where said flow path is closed and a second position where said flow path is open to allow the air in the interior volume to flow from the interior through said flow path to the surface of the support, said device comprising a tubular member having opposite open ends and having a longitudinal bore, said valve element comprising a sleeve and said flow path comprises a bore in said sleeve extending from one end of said sleeve to adjacent the opposite end, said sleeve being located in said tubular member, said valve element, when in said first position, having said one end thereof projecting from said tubular member, and when in said second position, said one end of said valve elements projects to a lesser extent from said tubular member than when in said first position.

* * * * *